United States Patent [19]

Goode

[11] Patent Number: 5,024,866

[45] Date of Patent: Jun. 18, 1991

[54] COMPOSITE SKI POLE AND METHOD OF MAKING SAME

[75] Inventor: David P. Goode, Bloomfield Hills, Mich.

[73] Assignee: SKI Accessories, Inc., Waterford, Mich.

[21] Appl. No.: 296,222

[22] Filed: Jan. 12, 1989

[51] Int. Cl.[5] ..... A63C 11/22

[52] U.S. Cl. ..... 428/36.4; 280/819

[58] Field of Search ..... 428/36.4; 280/819

[56] References Cited

U.S. PATENT DOCUMENTS 3,933,364 1/1976 With ..... 280/11.37 D 4,301,201 11/1981 Stout ..... 428/36

*Primary Examiner*—James Seidleck

*Attorney, Agent, or Firm*—Krass & Young

[57] ABSTRACT

A strong, lightweight, flexible ski pole and a method for making it. The ski pole comprises a filament-reinforced, resin-matrix composite shaft with anti-splinter material to prevent filament splinters from protruding from the outer surface of the shaft. In one embodiment, the shaft comprises a filament-reinforced, resin-matrix composite hollow outer shaft continuously integrally pultruded about a core member. In another embodiment of the invention, the shaft comprises a filament-reinforced, resin-matrix solid pultruded body. In both embodiments, a polyester veil is wrapped around the filaments within the resin matrix to prevent filament splinters from protruding from the outer surface of the ski pole shaft. Cut lengths of the ski pole shaft are fitted with a basket adaptor, a basket, a tip and a grip to make a finished ski pole.

6 Claims, 1 Drawing Sheet

COMPOSITE SKI POLE AND METHOD OF MAKING SAME

FIELD OF THE INVENTION

The present invention relates to ski poles and in particular to ski poles having shafts comprising filament/resin composites.

BACKGROUND OF THE INVENTION

Conventional ski poles typically comprise hollow, tapered shafts made of aluminum or some other lightweight metal, with a basket and tip mounted on one end and a hand grip mounted on the other end. Because of their tapered shape and the materials from which they are made, these conventional ski poles require a substantial amount of time and effort to manufacture and are accordingly expensive to produce.

Another significant characteristic of the traditional aluminum ski pole is the fact that the shafts are soft and tend to permanently deform or even collapse under the bending loads which are commonly encountered during skiing. When bent to the point of partial collapse, the pole shafts cannot be restored to original shape and strength.

In recent years, ski pole shafts comprising filament/resin composites have been proposed as alternatives to conventional aluminum shafts. U.S. Pat. No. 4,301,201 (Stout) discloses one such alternative ski pole shaft comprising an annular array of continuous reinforcing filaments embedded in a synthetic resin matrix and formed into a hollow tubular shaft by the process known as pultrusion. The filaments extend rectilinearly along the length of the shaft.

While such poles possess some advantages over conventional aluminum poles, they also possess disadvantages which greatly detract from their utility and marketability. The hollow pultruded shaft disclosed in U.S. Pat. No. 4,301,201 (Stout) lacks sufficient strength to adequately support the body weight of a skier, i.e. it tends to give or bend too much, and it is relatively easily crushed. Also, the filaments near the surface in composite shafts tend to break or splinter under bending loads, protruding from the surface of the prior art ski pole shaft and creating a splinter hazard to the user's hands.

SUMMARY OF THE INVENTION

According to the method aspect the present invention is a strong, lightweight, flexible, composite, aesthetically appealing ski pole which overcomes the performance disadvantages of prior art aluminum and composite ski poles. The subject ski pole comprises a shaft, a basket adapter mounted adjacent the lower end of the shaft for receiving a basket, a tip mounted on the lower end of the shaft, and a hand grip mounted on the opposite or upper end of the shaft. The shaft itself comprises a resin-matrix filament-reinforced composite body having an outer layer of anti-splinter material to prevent filament splinters from protruding from the outer surface of the shaft.

In its preferred forms, the subject ski pole shaft is strong, flexible, lightweight, inexpensive to produce, and generally has a more slender, streamlined appearance than prior art ski poles; i.e., it is preferably on the order of 0.30 to 0.50 inches in diameter. The reinforcing filaments can comprise glass, carbon, or Kevlar fibers, for example, or any combination thereof, depending on the desired stiffness of the ski pole. The filaments run rectilinearly along the length of the shaft. The anti-splinter material is preferably a polyester veil wrapped around the filaments within the resin-matrix, although other materials may be used. The resin may be any suitable thermosetting resin. The shaft is preferably cylindrical and non-tapered, but tapered shafts are also possible according to the present invention.

In a first embodiment of the invention, the shaft comprises a filament-reinforced resin-matrix hollow outer shaft integrally pultruded about a core member. The core member extends substantially along the entire length of the hollow outer shaft to strengthen the hollow outer shaft without adding excessive weight thereto. The core member may comprise a length of solid foam having suitable compression and weight characteristics, or alternately an extruded thermoplastic material, or almost any suitable substance such as wood or the same material which the filaments comprise. A layer of anti-splinter material surrounds the filaments to prevent filament splinters from protruding from the outer surface of the shaft. The shaft is a cylindrical, non-tapered pole approximately 0.40 inches in diameter. A basket adapter, basket, tip and grip are adhesively or frictionally attached to the shaft to make a finished ski pole.

According to a second aspect of the invention, a method for making the ski pole shaft comprises the steps of pultruding an array of continuous reinforcing filaments through a bath of thermosetting resin, continuously feeding a core member into the filament array prior to the entrance to the resin bath, providing the filaments with a layer of anti-splinter material, further pultruding the core member, the filaments and the anti-splinter material through a thermosetting die to form a ski pole shaft and cutting the continuously pultruded ski pole shaft into suitable lengths. The ski pole shaft lengths are then fitted with a basket adapter, a basket, a tip and a grip to make a finished pole.

In a second embodiment of the method invention, the shaft comprises a filament-reinforced resin-matrix composite solid pultruded body with a layer of anti-splinter material surrounding the filaments. The shaft is a cylindrical, non-tapered pole approximately 0.40 inches in diameter or less, with a basket adapter, basket, tip and grip adhesively or frictionally attached thereto to make a finished ski pole.

A method for making the shaft and ski pole of the second embodiment comprises the steps of pultruding an array of continuous reinforcing filaments through a bath of thermosetting resin, providing the filaments with a layer of anti-splinter material, further pultruding the filaments and the anti-splinter material through a thermosetting die to form a ski pole shaft and cutting the continuously pultruded ski pole shaft into suitable lengths.

In both embodiments the resin may be precolored to eliminate any painting of the finished shaft, and the shaft may be embossed with a logo or design before being cut into separate lengths. The cut lengths of ski pole shaft require no additional work or processing other than the simple addition of adapter, basket, tip and grip.

DETAILED DESCRIPTION OF THE ILLUSTRATED EMBODIMENT

Figure 1:
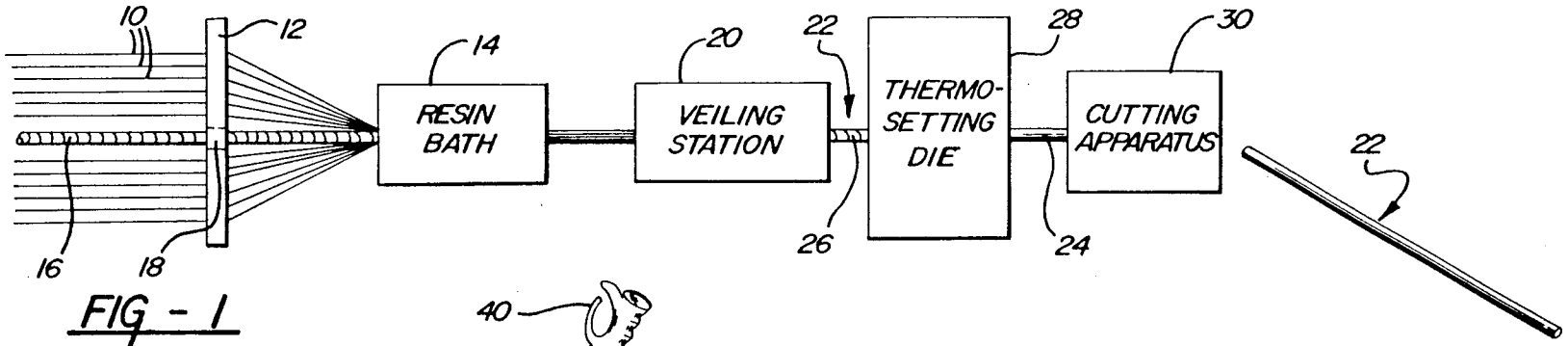
FIG. 1 is a schematic view of a method for forming a ski pole shaft according to a first embodiment of the present invention.

Referring now to FIG. 1, the process for making a ski pole shaft according to a first embodiment of the present invention is shown in schematic form. An array of continuous reinforcing elements 10 is pultruded from a suitable filament supply (not shown). Filaments 10 may comprise glass, carbon, or Kevlar filaments, for example, or the array may comprise a combination of different filaments. The array of filaments is pultruded through a suitable guide member 12, which channels the filaments into a resin bath 14 containing a thermosetting synthetic resin in liquid form.

Prior to the entrance to resin bath 14, a continuous solid foam core member 16 is extruded from a conventional extruding apparatus (not shown) through a suitable aperture 18 in guide member 12 and into the array of filaments 10, such that when core member 16 enters resin bath 14 it is intimately surrounded by filaments 10. Together filaments 10 and core member 16 are pultruded/extruded through resin bath 14, filaments 10 and core member 16 becoming thoroughly coated with the thermosetting resin.

In an alternate embodiment, core member 16 may comprise an extruded thermoplastic core. In fact, core member 16 may comprise almost any suitable material including the same material used for filaments 10.

To prevent splinters of filaments 10 from protruding from the resin-matrix outer surface of the finished ski pole shaft 22 and creating the potential for injury to the hands of someone holding or carrying the ski pole, resin-coated filaments 10 are next provided with a thin polyester veil 26 at veiling station 20 prior to thermosetting die 28. Polyester veil 26 comprises a sheet or veil of a suitable polyester wrapped or wound around filaments 10 on core member 16. Polyester veil 26 is typically perforated to permit the liquid resin on filaments 10 and core member 16 to flow through and over the veil, covering it completely. If desired, veil 26 may first be dipped in a different thermosetting resin before being applied to filaments 10.

Core member 16 and surrounding resin-coated filaments 10 and polyester veil 26 are then further pultruded into and through a heated thermosetting die 28 to set the liquid resin and define the final cylindrical, non-tapered shape of ski pole shaft 22. The continuous ski pole shaft 22 emerging from die 28 now comprises a resin-matrix, filament-reinforced hollow outer shaft portion 24 integrally pultruded about core member 16. The outer surface of ski pole shaft 22 is smooth resin, anti-splinter polyester veil 26 being embedded completely within the resin-matrix immediately adjacent filaments 10. The continuously pultruded ski pole shaft 22 is then cut by cutting apparatus 30 into lengths suitable for use as ski poles.

Painting of ski pole shaft 22 can be eliminated by pre-coloring the thermosetting resin in resin bath 14 so that the shaft 22 coming from thermosetting die 28 already has its final color. If desired, a logo or design can be applied to the shaft 22 while it is still continuous, i.e. between thermosetting die 28 and cutting apparatus 30. A logo or design can also be applied to polyester veil 26 and the color of the thermosetting resin chosen so that the logo or design is visible through the layer of set resin covering veil 26.

The non-tapered continuously-pultruded ski pole shaft 22 requires almost no additional work once it has been cut to length: the final shape and color of shaft 22 are already set; no assembly or insertion of core member 16 into ski pole shaft 22 is needed, since core member 16 has already been continuously integrally formed with ski pole shaft 22; and the smooth, resin-rich, splinter-free outer surface of ski pole shaft 22 requires no smoothing or finishing operations. Accordingly, the manufacturing cost of the ski pole shaft 22 produced by the process illustrated in FIG. 1 is very low.

Still referring to FIG. 1, the process for making a ski pole shaft according to a second embodiment of the invention is essentially the same as the process for the first embodiment except that the step of feeding core member 16 into the array of filaments 10 prior to resin bath 14 is omitted. The array of filaments 10 is pultruded through guide member 12, which channels the filaments into resin bath 14, filaments 10 becoming thoroughly coated with the thermosetting resin. The resin-coated filaments 10 are provided with polyester veil 26 in the same manner disclosed for making the first embodiment of the invention. Resin-coated filaments 10 and polyester veil 26 are then further pultruded into and through heated thermosetting die 28 to set the liquid resin and define the final cylindrical, non-tapered shape of ski pole shaft 22. The continuous ski pole shaft 22, now emerging from die 28 comprises a resin-matrix filament-reinforced solid shaft. The outer surface of the solid shaft is smooth resin, anti-splinter polyester veil 26 being embedded completely within the resin-matrix immediately adjacent filaments 10. The continuously pultruded solid ski pole shaft 22 is then cut by cutting apparatus 30 into lengths suitable for use as ski poles and finished in the same manner as the hollow outer shaft-/core member ski pole shaft of the first embodiment of the invention.

Since there is no core member in the solid pultruded ski pole shaft of the second embodiment, the resin-matrix will be substantially continuous throughout the shaft body, interrupted only by filaments and polyester veil 26. The solid ski pole shaft of this second embodiment can also typically be made thinner than the first embodiment having a core member.

While the ski pole shafts of the first and second embodiments are preferably non-tapered to eliminate additional manufacturing steps and to give them a distinctive appearance over the prior art ski poles, in some instances it may be desirable to taper the shaft. Tapering of the shaft is easily effected by introducing an intermittent tapering step, such as an intermittent tapering die or milling operation into the process shown in FIG. 1.

Figure 2:
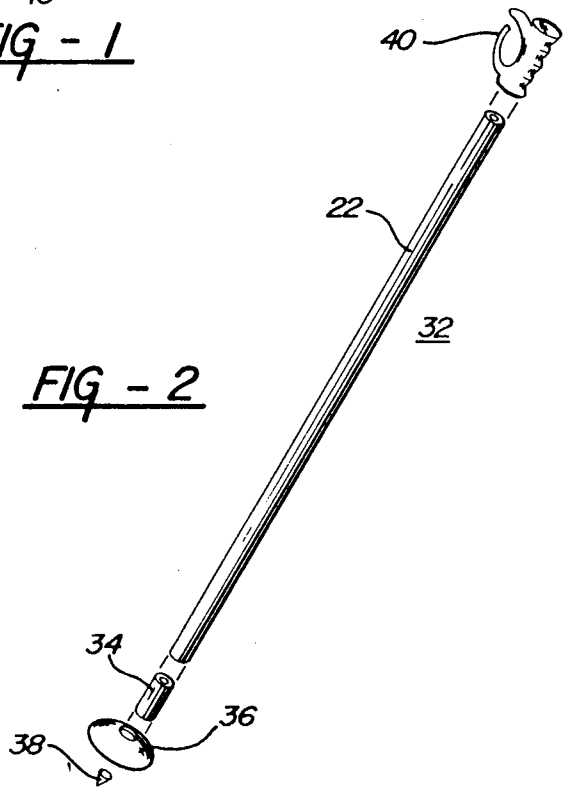
FIG. 2 is a perspective, exploded view of the finished ski pole of the present invention.

Referring now to FIG. 2, a finished ski pole 32 comprising ski pole shaft 22, basket adapter 34, basket 36, tip 38 and hand grip 40 is shown in an exploded view. Adapter 34 is adhesively bonded to shaft 22 near the arbitrarily chosen lower end of ski pole 22, basket 36 is next adhesively or frictionally mounted on adapter 34, and tip 38 is adhesively bonded to the lower end of shaft 22. Hand grip 40 can be adhesively or frictionally mounted on the opposite or upper end of shaft 2 to complete ski pole 22.

Figure 3A:
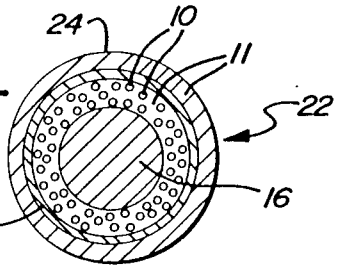
FIGS. 3*a*, 3*b* and 4 are cross-sectional end views of first, first alternate and second embodiments of a ski pole shaft according to the present invention.
Figure 3B:
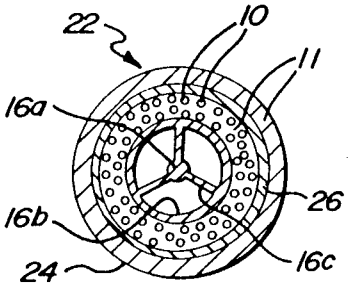
Figure 4:
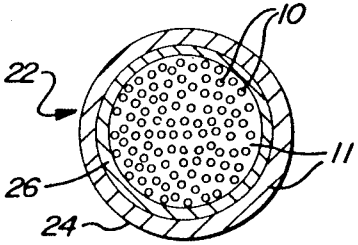

Referring to FIGS. 3*a*, 3*b* and 4, the core structures of the first, first alternate and second embodiments of ski pole shaft 22 can be seen in cross-section.

In FIG. 3*a*, hollow outer shaft 24 comprising reinforcing filaments 10 embedded in resin-matrix 11 has been integrally pultruded about core member 16, such that no separate assembly or bonding step is required to engage and maintain the two elements in a tight integral fit. Core member 16 comprises solid molded or extruded foam extending longitudinally along the entire length of hollow outer shaft 24. The lightweight, integrally pultruded foam core member 16 resiliently strengthens composite hollow outer shaft 24 enough to provide adequate support for a skier, and to resist crushing of the ski pole shaft, without making the ski pole excessively heavy.

In FIG. 3*b*, hollow outer shaft 24 comprising reinforcing filaments 10 embedded in a resin matrix 11 has been integrally pultruded about thermoplastic core member 16, such that no separate assembly or bonding step is required to engage and maintain the two elements in a tight, integral fit. Thermoplastic core member 16 comprises a longitudinal center rib 16*a* coaxial with and extending longitudinally along the entire length of hollow outer shaft 24, an annular outer wall portion 16*b* corresponding substantially to the inside diameter of hollow outer shaft 24, and a plurality of radially extending ribs 16*c* joining longitudinal rib 16*a* and annular wall 16*b*. Thermoplastic core member 16 strengthens shaft 22 in the same lightweight, flexible manner as foam core member 16 in FIG. 3*a*.

In FIG. 4, solid pultruded ski pole shaft 22 comprises an array of reinforcing filaments 10 embedded in resin matrix 11.

In all of the illustrated embodiments of FIGS. 3*a*, 3*b* and 4, ski pole shaft 22 is extremely tolerant of bending loads, i.e. even after severe bending ski pole shaft 22 simply returns to its normal straight orientation as soon as the bending load is removed. During severe bending, however, it is not uncommon for some of reinforcing elements 10 to break. While this breakage does not noticeably affect the overall performance of ski pole shaft 22, fine splinters of filaments 10 can protrude from the resin-matrix outer surface of shaft 22, creating a splinter hazard to the hands of the person using the pole. To prevent this, polyester veil 26 is wrapped or wound around filaments 10 in all of the illustrated embodiments to keep the outer surface of ski pole shaft 22 smooth, resin-rich and free of filament splinters which might otherwise protrude.

It is to be understood that the foregoing illustrated embodiment is a description of a preferred embodiment in accordance with 35 U.S.C. 112, and is not intended to be limiting. For example, the method for making the filament/resin composite outer shaft, non-composite inner core ski pole shaft of the first embodiment of the present invention is not limited to the process known as pultrusion, but may comprise any suitable method of continuously integrally forming a filament/resin composite outer shaft about a core member and still lie within the scope of the invention. The core member may comprise materials other than solid foam or extruded thermoplastic, and may be of any almost suitable form which provides sufficient strength to the hollow outer shaft and allows it to bend without breaking. The reinforcing filaments or fibers in both embodiments of the shaft are not limited to glass, carbon, or Kevlar filaments, but may comprise other suitable materials. The basket adapter, basket, tip and grip may take any suitable form and may be fastened to the shaft in any number of ways. Also, polyester veil 26 may comprise other suitable veiling materials and may be applied to filaments 10 before or after resin bath 14.

I claim:

1. A strong, lightweight, flexible, ski pole comprising:
a shaft;
a basket mounted adjacent a first lower end of said shaft;
a tip mounted on said first lower end of said shaft; and
a grip mounted on the opposite end of said shaft;
said shaft comprising filament-reinforced, resin-matrix composite body having an anti-splinter veil located on said shaft radially outward of said filaments; wherein, said anti-splinter veil comprises a polyester layer wrapped about said reinforcing filaments and embedded in said resin-matrix, and said filaments run essentially rectilinearly along said shaft.

2. A strong, lightweight, flexible, ski pole comprising:
a shaft;
a basket mounted adjacent a first lower end of said shaft;
a tip mounted on said first lower end of said shaft;
a grip mounted on the opposite end of said shaft; and
said shaft comprising a filament-reinforced, resin-matrix composite hollow outer shaft continuously integrally pultruded about a core member; wherein, said shaft further comprises anti-splinter means to prevent splinters of said filaments from protruding from the outer surface of said shaft, said anti-splinter means comprise a polyester veil disposed about said filaments and embedded in said resin-matrix, and said filaments run essentially rectilinearly along said shaft.

3. A strong, lightweight, flexible, ski pole comprising:
a shaft;
a basket mounted adjacent a first lower end of said shaft;
a tip mounted on said first lower end of said shaft;
a grip mounted on the opposite end of said shaft; and
said shaft comprising a filament-reinforced, resin-matrix solid pultruded body, wherein said shaft further comprises anti-splinter means comprising a polyester veil wrapped around said filaments and embedded in said resin-matrix, and said filaments run essentially rectilinearly along the length of said shaft.

4. A strong, lightweight, flexible, ski pole comprising:
a shaft;
a basket mounted adjacent a first lower end of said shaft;
a tip mounted on said first lower end of said shaft;
a grip mounted on the opposite end of said shaft; and
said shaft comprising a filament-reinforced, resin-matrix composite body having an anti-splinter veil disposed about said reinforcing filaments and said resin matrix, wherein said filaments run essentially rectilinearly along the length of said shaft.

5. A strong, lightweight, flexible, ski pole comprising:
a shaft;
a basket mounted adjacent a first lower end of said shaft;
a tip mounted on said first lower end of said shaft;
a grip mounted on the opposite end of said shaft; and
said shaft comprising a filament-reinforced, resin-matrix composite hollow outer shaft continuously integrally pultruded about a core member and further comprising anti-splinter means disposed about said filaments and said resin matrix to prevent splinters of said filaments from protruding from the outer surface of said shaft, wherein said filaments run essentially rectilinearly along the length of said shaft.

6. A strong, lightweight, flexible, ski pole comprising:

a shaft;

a basket mounted adjacent a first lower end of said shaft;

a tip mounted on said first lower end of said shaft;

a grip mounted on the opposite end of said shaft; and said shaft comprising a filament-reinforced, resin-matrix solid pultruded body and further comprising anti-splinter means disposed about said filaments and said resin matrix, wherein said filaments run essentially rectilinearly along the length of said shaft.

* * * * *